US005536133A

United States Patent [19]

Velez et al.

[11] Patent Number: 5,536,133

[45] Date of Patent: Jul. 16, 1996

[54] PIVOT FRAME ROLL CLAMP ASSEMBLY FOR ATTACHMENT TO A LIFT TRUCK

[75] Inventors: Lawrence R. Velez, Houston; Stuart W. Sinclair, Austin, both of Tex.

[73] Assignee: Long Reach Holdings, Inc., Houston, Tex.

[21] Appl. No.: 386,496

[22] Filed: Feb. 10, 1995

[51] Int. Cl.[6] ..... B66F 9/18

[52] U.S. Cl. ..... 414/620; 294/86.41; 294/88; 414/621; 414/911

[58] Field of Search ..... 414/607, 911, 414/619–621, 642, 672; 294/88, 106, 86.41

[56] References Cited

U.S. PATENT DOCUMENTS

| | | | |
|---|---|---|---|
| 2,596,477 | 5/1952 | Frischmann et al. | 414/620 |
| 2,815,878 | 12/1957 | Vance | 414/620 |
| 3,180,672 | 4/1965 | Bjorklund et al. | 294/88 |
| 3,252,609 | 5/1966 | Ellis | 414/620 |
| 3,407,951 | 10/1968 | Faust et al. | 414/621 |
| 3,759,564 | 9/1973 | Seaberg | 294/88 |
| 3,896,957 | 7/1975 | Sinclair | 414/911 X |
| 4,160,620 | 7/1979 | Farmer et al. | 414/911 X |
| 4,227,850 | 10/1980 | Farmer et al. | 294/88 X |
| 4,435,119 | 3/1984 | House | 414/620 |

FOREIGN PATENT DOCUMENTS

| | | | |
|---|---|---|---|
| 95099 | 4/1991 | Japan | 414/621 |
| 537947 | 2/1977 | U.S.S.R. | 414/620 |

*Primary Examiner*—David A. Bucci
*Attorney, Agent, or Firm*—Fulbright & Jaworski

[57] ABSTRACT

A lift truck pivot frame paper roll handling clamp assembly for engaging and moving paper rolls of varying diameter. The clamp has a mounting frame that is rotatably mounted on a lifting apparatus of the lift truck. A pair of sub-frames are pivotally attached to the mounting frame by four pivot arms which permit eccentrical pivoting of the sub-frame in relation to the mounting frame. This eccentric pivotal motion is essentially a guided linear side shift movement of one end of the sub-frame and guided a circular segment path at the other end thereof. This results in a turning generally about a "floating point" approximately halfway between the center of gravity of the roll and the body of the clamp. The clamp assembly also includes a pair of hydraulically actuated opposing clamp arms pivotally connected to the sub-frame for gripping paper rolls of varying diameter. The sub-frame may be eccentrically pivoted between a retracted position where the opposing clamp arms extend an equal distance forward and an extended position where one opposing clamp arm extends forwardly further than the other clamp arm. When the roll clamp is pivoted between the equal arm extension position and the unequal arm position, the roll clamp's center of gravity experiences an upward or downward side shift along an arcuate path, while the roll's center of gravity experiences an opposite downward or upward side shift along an arcuate path.

19 Claims, 5 Drawing Sheets

FIG. 1
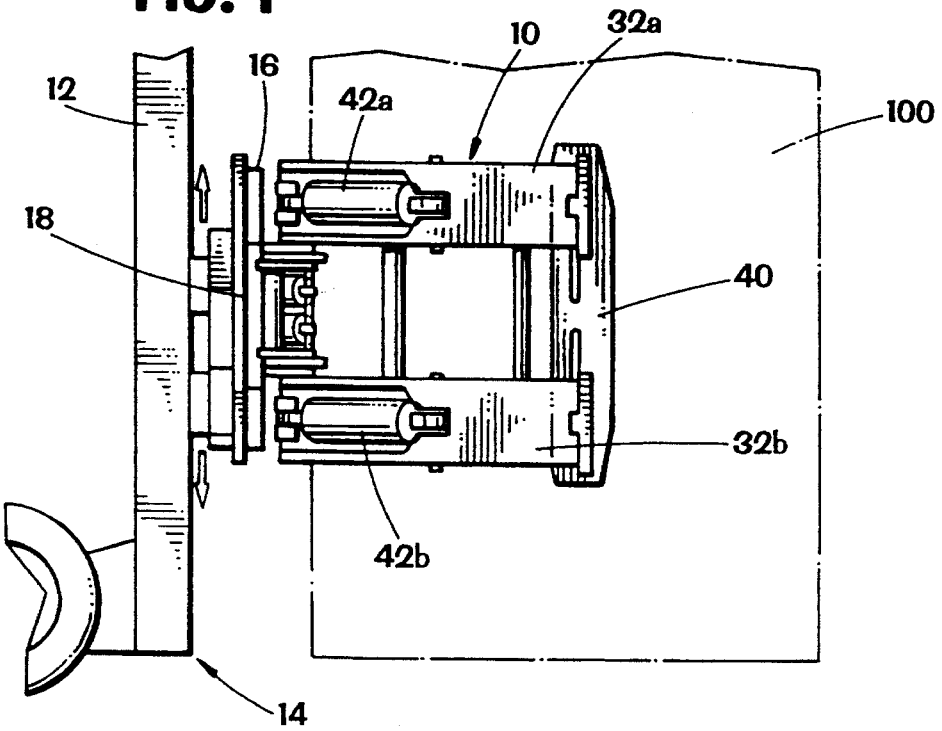
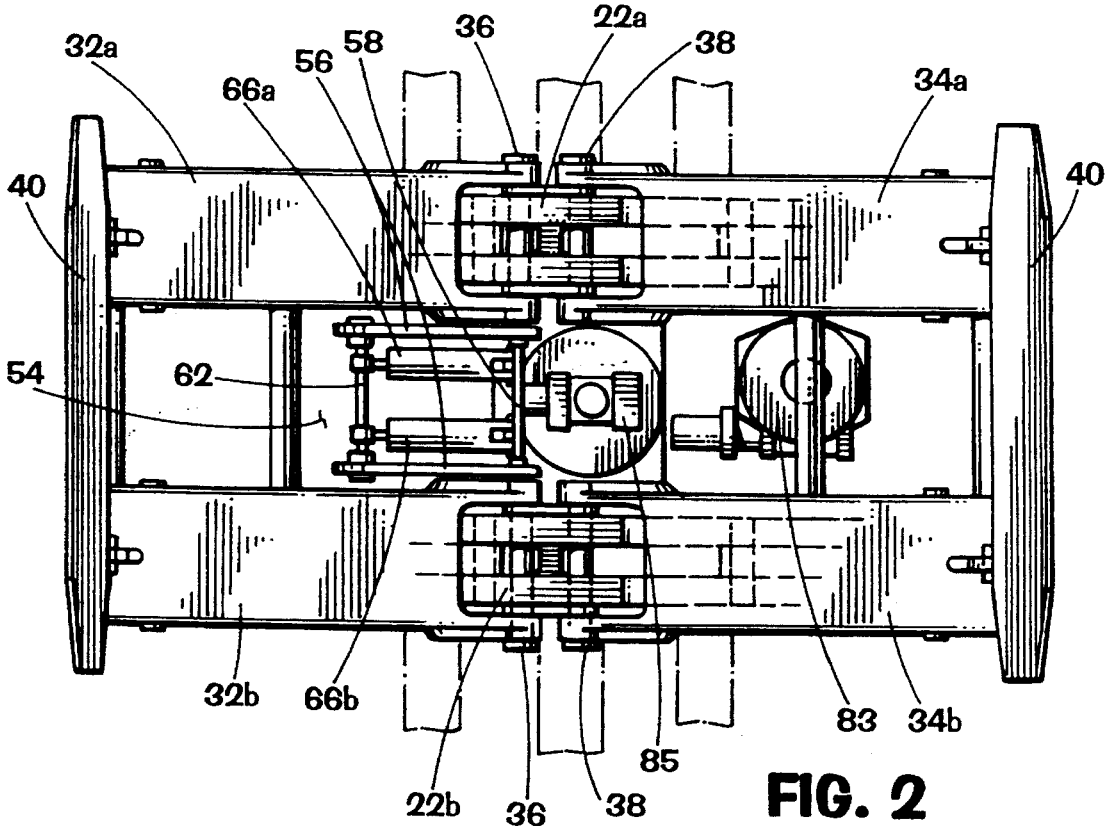
FIG. 2

PIVOT FRAME ROLL CLAMP ASSEMBLY FOR ATTACHMENT TO A LIFT TRUCK

BACKGROUND OF THE INVENTION

1. Field of the Invention

The present invention relates to a clamp assembly for attachment to a lifting apparatus of a lift truck, and more particularly, to a pivot frame roll clamp assembly for picking up, transporting and stacking large rolls of paper.

2. Description of the Related Technology

A variety of pivoted paper roll clamp assemblies have been utilized in the past wherein the arms of the clamp shift between an equal arm length position where the opposing clamp arms extend an equal distance forward of the lift truck, and an unequal arm length position where one clamp arm extends a greater distance forward of the lift truck than the other clamp arm. The unequal arm extension position is needed when a paper roll is lying on a horizontal surface, such as the floor, so that the longer upper clamp arm can overreach the lower clamp arm in order to assume substantially diametrically opposed positions for grasping the roll firmly to pick it up. The equal arm extension position is needed to facilitate placement of a vertical roll in close proximity with other vertically positioned rolls in a compact array, as well as to remove such a roll from the array.

One such prior art roll clamp includes the paper roll load clamp having a power-actuated pivotal subframe shown in House, U.S. Pat. No. 4,435,119. The House roll clamp includes a subframe that is pivotally connected to the rotatable frame of the clamp near the axis of rotation. Clamp arms are pivotally mounted upon the subframe on each side of the pivotal connection between the subframe and the rotatable frame. A hydraulic subframe actuator pivots the subframe angularly in relation to the rotatable frame, thereby angularly shifting the clamp arms as a single unit relative to the rotating frame. One of the clamp arms is longer than the other to provide for the desired unequal arm extension necessary to engage a roll positioned on a horizontal surface. Because of the unequal arm lengths, the arms must travel through varying arcuate motion to achieve proper closure.

Several disadvantages are present in the prior art clamps. Because the subframe of clamp shown in U.S. Pat. No. 4,435,119 is pivotally connected to the rotatable frame at a single midpoint, shifting between positions of equal arm extension and unequal arm extension is often jerky and violent. In many prior art paper roll clamps, the center of gravity of the roll may be shifted forward during movement between the unequal arm extension position and the equal arm extension position causing instability of the lift truck.

For the foregoing reasons, there is a need for a lift truck roll clamp assembly where the forward movement of the roll's center of gravity is minimized as the clamp shifts from a position of unequal arm extension to a position of equal arm extension. There is also a need for a roll clamp wherein the clamp can be smoothly shifted between the unequal arm extension position and the equal arm extension position.

SUMMARY OF THE INVENTION

The present invention is directed to a pivot frame roll clamp assembly where a pivot frame pivots eccentrically in relation to the mounting frame of the clamp permitting a smooth shift between the unequal arm length position and the equal arm length position. The pivot frame of the present invention is not pivoted about a single point on the mounting frame. To the contrary, the center of rotation swings through an arc as the pivot frame is pivoted eccentrically with respect to the mounting frame. The result is a minimal forward shift of the roll's center of gravity when the clamp is shifted from the unequal arm extension position to the equal arm extension position. Furthermore, the side shift in the roll's center of gravity is offset by an opposite side shift in the center of gravity of the clamp assembly as it pivots along an arcuate path.

A pivot frame roll clamp assembly having features of the present invention comprises means for rotatably mounting the pivot frame roll clamp assembly upon a lifting apparatus of a lift truck, means for engaging a cylindrical object, and means for eccentrically pivoting the means for engaging with respect to the rotatable mounting means.

The rotatable mounting means may preferably comprise a mounting frame configured to be rotatably mounted upon the lifting apparatus of the lift truck. The mounting frame may be configured to permit the pivot frame roll clamp assembly to rotate a full 360 degrees about its axis of rotation. Preferably, the clamp is rotated between a substantially horizontal position and a substantially vertical position.

The eccentrical pivoting means may preferably comprise a pivot frame connected to the mounting frame for permitting eccentric pivotal motion of the sub-frame with respect to the mounting frame. A plurality of pivot arms may be provided for connecting the sub-frame to the mounting frame. Each pivot arm may exhibit a first end pivotally connected to the sub-frame and a second end pivotally connected to the mounting frame. Preferably, four pivot arms are provided.

The engaging means may include first and second clamp arms pivotally connected at a first end thereof to the sub-frame. The first clamp arm exhibits a length equal to a length of the second clamp arm. A paper roll contact pad may be mounted on a second end of each of the first and second clamp arms to engage a cylindrical paper roll to be lifted and transported.

The clamp assembly may further include pivot frame motive means for eccentrically pivoting the sub-frame with respect to the mounting frame. The pivot frame motive means may comprise a pivot yoke having a first end pivotally connected to the sub-frame, a yoke stabilizer having a first end pivotally connected to the mounting frame and a second end pivotally connected to a second end of the pivot yoke, and a hydraulic cylinder having a first end connected to the mounting frame and a second end pivotally connected to the second end of the pivot yoke and the second end of the yoke stabilizer.

The clamp assembly may further include clamp arm motive means for selectively pivoting the first and second clamp arms to selectively open and close the space between the clamp arms. The clamp arm motive means may comprise at least first and second hydraulic cylinders for urging the first and second clamp arms toward an open position or a closed position. Each hydraulic cylinder may exhibit a first end connected to one of the clamp arms and a second end connected to the sub-frame.

Accordingly, it is a primary objective of the present invention to provide a lift truck roll clamp where the forward shift in the roll's center of gravity is minimized. It is a further objective to provide a clamp where the side shift in the roll's center of gravity is offset by a corresponding opposite side shift in the center of gravity of the clamp assembly.

Still another objective of the invention is to provide an apparatus having a roll clamp assembly which shifts smoothly between a position of unequal arm extension and an equal arm extension position.

These and other objectives, features and aspects of the present invention will become better understood with regard to the following description, claims and accompanying drawings.

BRIEF DESCRIPTION OF THE DRAWINGS

FIG. 1 shows a side elevational view of a lift truck and a pivot frame roll clamp assembly according to the invention, shown holding a large diameter paper roll in a vertical position.

FIG. 2 shows a front elevational view of the pivot frame roll clamp assembly of FIG. 1 with the clamp arms shown in an open position.

DESCRIPTION OF THE PREFERRED EMBODIMENTS

Figure 4:
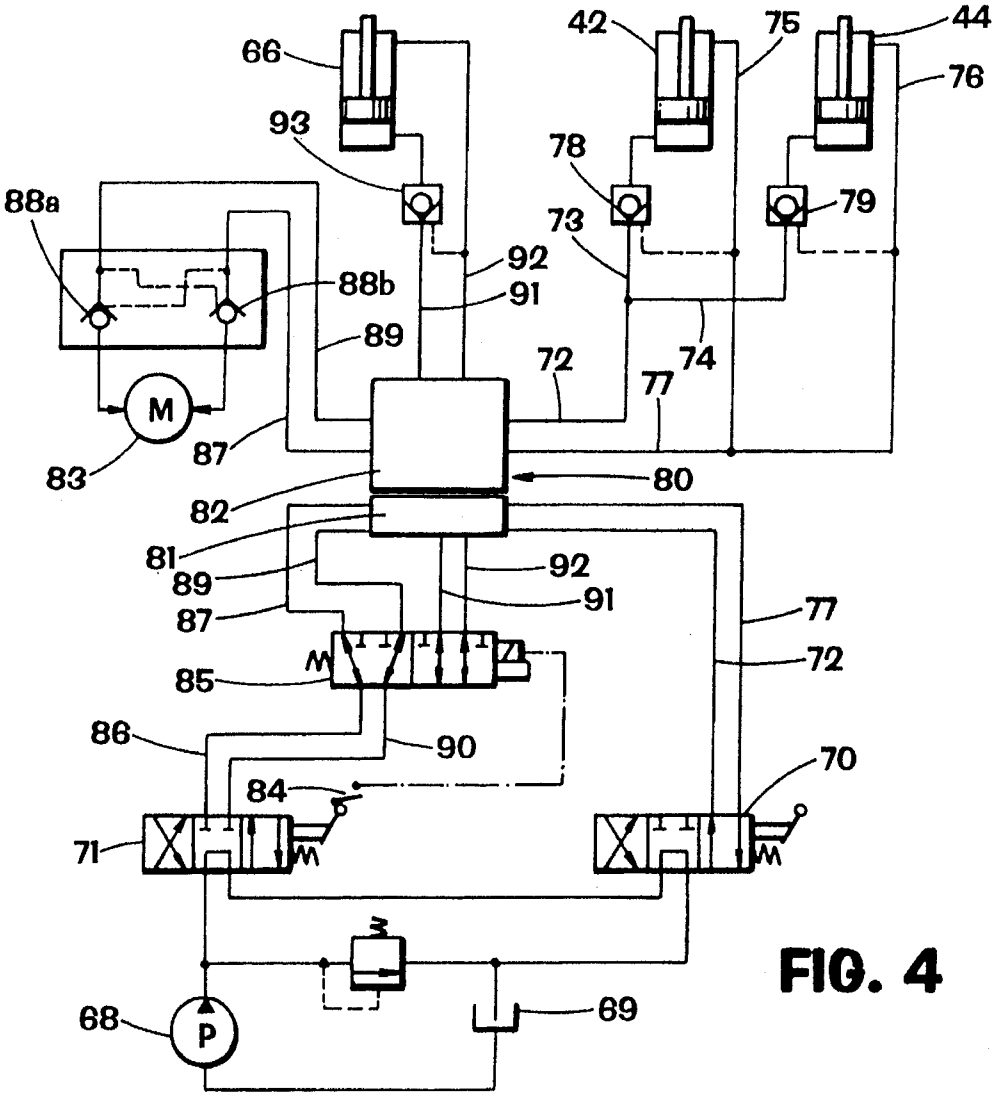
FIG. 4 shows a simplified hydraulic circuit diagram showing the manner in which the hydraulic cylinders controlling movement of components of the clamp assembly are actuated.

As shown in FIG. 1, a pivot frame roll clamp assembly 10 according to one preferred embodiment of the invention is mounted on a lifting apparatus 12 at the forward end of a lift truck 14. The lifting apparatus 12 permits the clamp assembly 10 to be selectively moved upwardly or downward! y along the longitudinal axis of the lifting apparatus 14. The clamp assembly 10 includes a mounting frame 16 which is rotatably mounted to the lifting apparatus 12 of the lift truck 14 by means of a rotator 18. The rotator 18 provides powered rotation of the mounting frame in relation to the lifting apparatus 12 about an axis of rotation 20 (see FIGS. 5 and 6) extending generally from the midsection of the mounting frame 16 perpendicular to the longitudinal axis of the lifting apparatus 14. Actuation of the rotator 18 allows the clamp assembly 10 to rotate a full 360 degrees. Preferably, the clamp rotates between a substantially horizontal position where a horizontally positioned paper roll can be engaged, and a substantially vertical position as shown in FIG. 1.

Figure 3:
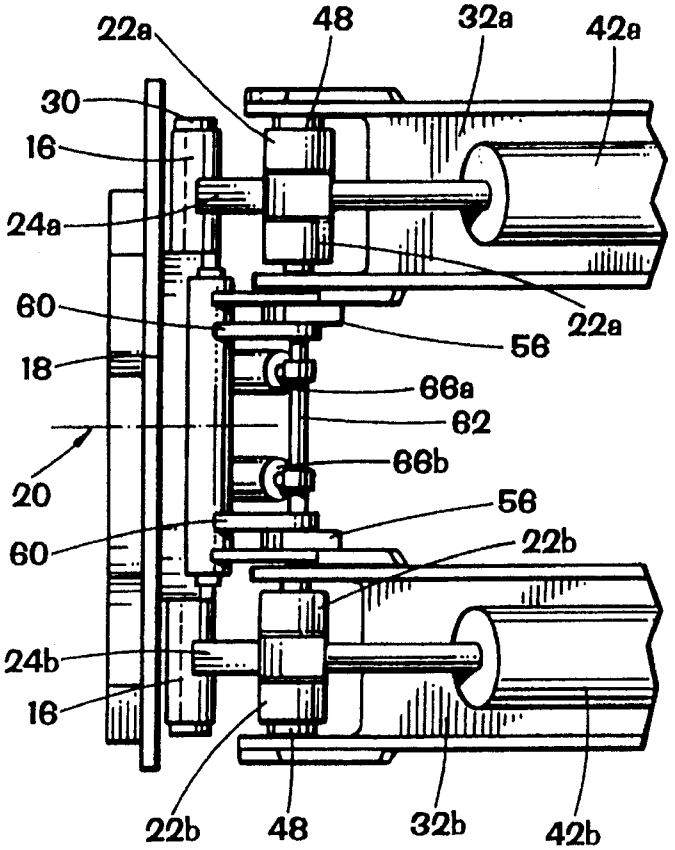
FIG. 3 shows an enlarged side elevational view of a portion of the clamp assembly of FIG. 1.
Figure 7:
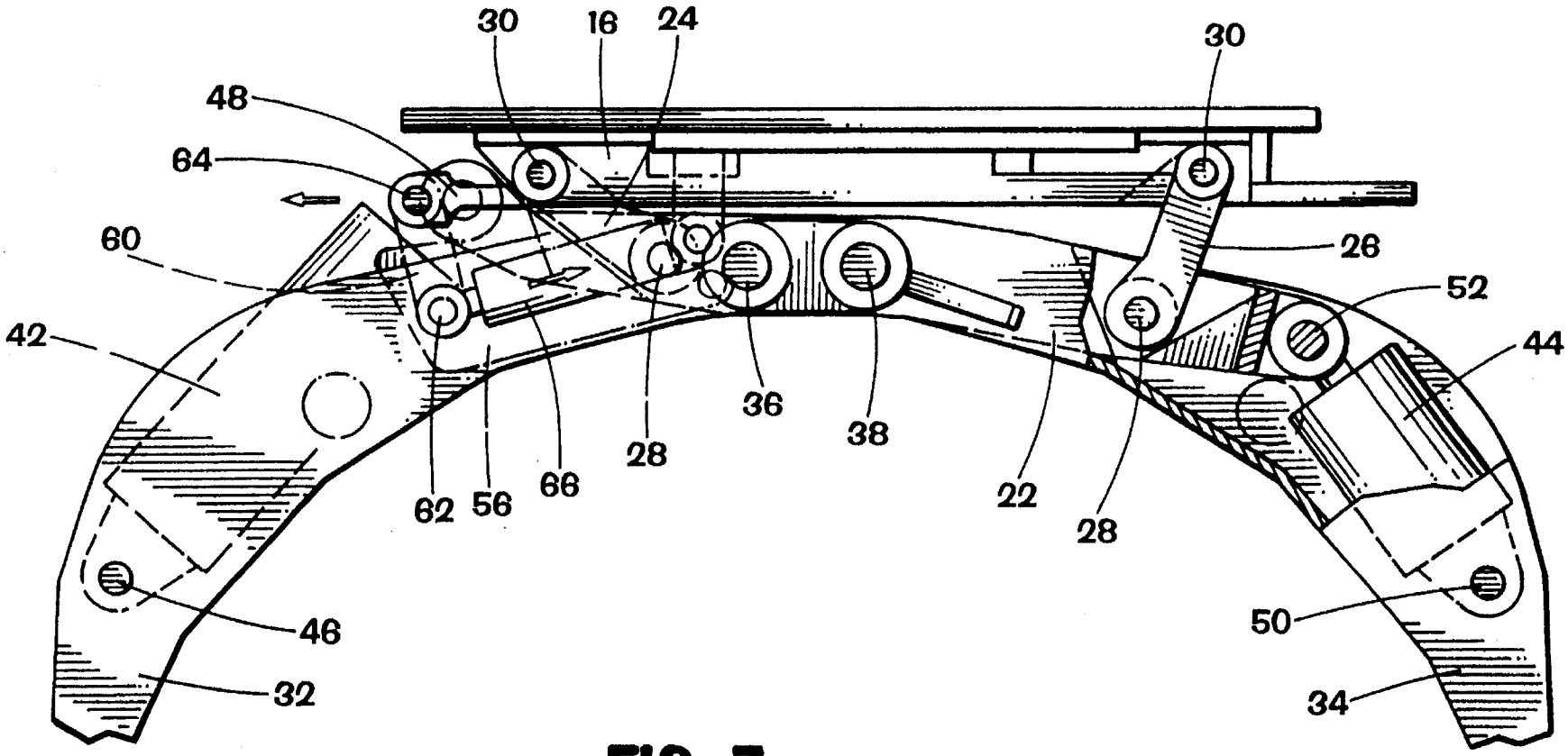
FIG. 7 shows an enlarged side view of a portion of the clamp assembly of FIG. 1 shown in an equal arm extension position.

Referring to FIG. 2, FIG. 3 and FIG. 7, a sub-frame 22, comprising upper pivot frame member **22*a* and lower pivot frame member 22*b*, is pivotally connected to the mounting frame 16 by pivot arms 24, 26. Each pivot arm has a first end pivotally connected to the sub-frame 22 by a pivot pin 28 and a second end pivotally connected to the mounting frame 16 by a pivot pin 30. The pivot arms 24 and 26 each comprise upper pivot arm members 24*a* and 26*a*, respectively, and lower pivot arm members 24*b* and 26*b*, respectively, which correspond to upper and lower sub-frame members 22*a* and 22*b* as shown in FIG. 3. The pivot arms permit eccentric pivotal motion of the sub-frame 22 in relation to the mounting frame 16. This eccentric pivotal motion is essentially a guided linear side shift movement of one end of the sub-frame 22 and guided circular segment path at the other end thereof. This results in a turning generally about a "floating point" approximately halfway between the center of gravity of the roll and the body of the clamp 10**.

Figure 6:
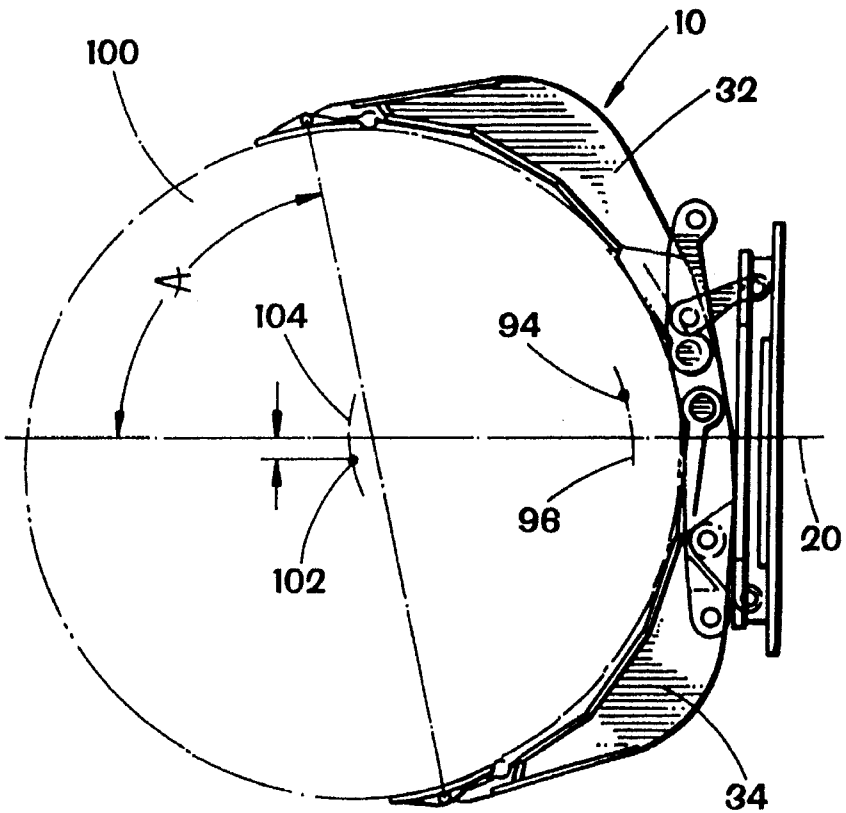
FIG. 6 shows a side view of the clamp assembly of FIG. 1 shown holding a large diameter roll in an unequal arm extension position.

A pair of opposing clamp arms 32 and 34 are pivotally connected to the sub-frame 22 by pivot pins 36 and 38, respectively. Each clamp arm 32, 34 respectively comprises an upper clamp arm member **32*a*, 34*a* and a lower clamp arm member 32*b*, 34*b* connected at a distal end by a paper roll contact pad 40. The clamp arms 32 and 34 are preferably of equal length. Clamp arm 32 is referred to as the "long side" clamp arm because it extends a greater distance forward when the arms are in the unequal extension position as shown in FIG. 6. Likewise, clamp arm 34 is referred to as the "short side" clamp arm. Clamp arm motive means, comprising a plurality of hydraulically actuated cylinders are provided to selectively pivot the clamp arms 32 and 34 about their respective pivot pins 36 and 38 to selectively open and close the space between the clamp arms. According to the preferred embodiment, each clamp arm 32, 34 is provided with a corresponding hydraulic cylinder 42, 44 for urging the clamp arm toward an open position or a closed position. The fixed end of the "long side" hydraulic cylinder 42 is preferably connected to the clamp arm 32 by a pivot pin 46 and the extendable ram end thereof is connected to the sub-frame 22 by a pivot pin 48. The extendable ram end of the "short side" hydraulic cylinder 44 is connected to the clamp arm 34 by a pivot pin 50 and the fixed end thereof is connected to the sub-frame 22 by a pivot pin 52. Upper and lower "long side" clamp arm members 32*a* and 32*b* exhibit corresponding upper and lower "long side" hydraulic cylinders 42*a* and 42*b*. Likewise, upper and lower "short side" clamp arm members 34*a* and 34*b* exhibit corresponding upper and lower "short side" hydraulic cylinders 44*a* and 44*b***.

Figure 5:
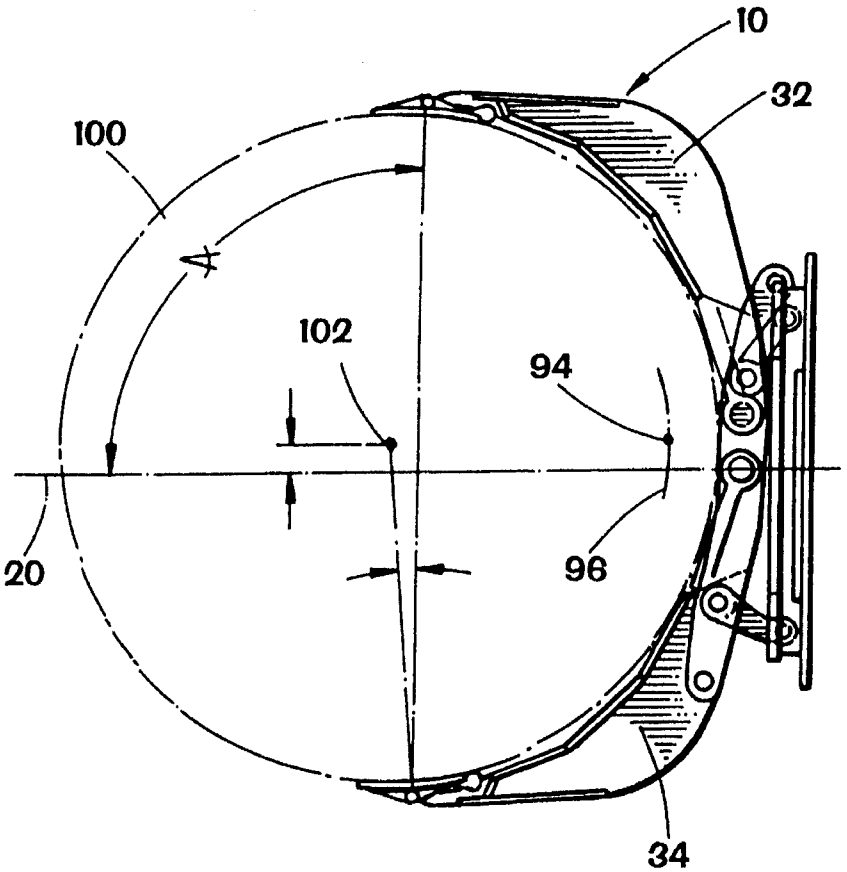
FIG. 5 shows a side view of the clamp assembly of FIG. 1 shown holding a large diameter roll in an equal arm extension position.

The sub-frame is driven between a retracted position wherein the clamp arms are in an equal extension position, as shown in FIG. 5, to an extended position wherein the clamp arms are in an unequal extension position, as shown in FIG. 6 by pivot frame motive means 54. The pivot frame motive means 54 causes the sub-frame 22 to be eccentrically pivoted with respect to the mounting frame 16. According to a first preferred embodiment, the pivot frame motive means 54 includes a pivot yoke 56 having a first end pivotally connected to the sub-frame 22 and "long side" clamp arm 32 by pivot pin 36. The other end of the pivot yoke 56 is pivotally connected to a first end of a yoke stabilizer 60 by pivot pin 62. The second end of the yoke stabilizer is pivotally connected to the mounting frame 16 by pivot pin 64. A pair of hydraulic cylinders **66*a*, 66*b*, each having a fixed end pivotally connected to the mounting frame 16 and an extendable end connected to the pivot yoke 56 and the yoke stabilizer 60 by way of pivot pin 62, provide the force necessary to move the sub-frame 22 between the extended and retracted positions. According to an alternative embodiment, a single hydraulic cylinder 66 can be substituted for the pair of hydraulic cylinders 66*a* and 66*b***.

FIG. 4 shows a circuit diagram of the hydraulic control system for selective actuation of the respective hydraulic cylinder ram assemblies 42, 44 and 66. A hydraulic pump 68, a hydraulic fluid reservoir 69 and two control valves 70 and 71 are provided on the lift truck 14. The remaining components shown in FIG. 4 are provided on the clamp body 10.

The first control valve 70 regulates the flow of pressurized fluid from the hydraulic pump 68 to the clamp arm hydraulic cylinders 42 and 44. To close the clamp arms, the lift truck operator moves the spool of the control valve 70 to the left, thereby directing pressurized fluid from the hydraulic pump 68 through conduit 72 and conduits 73 and 74 simultaneously to the bases of hydraulic cylinders 42 and 44 while fluid is simultaneously exhausted from the forward end of the hydraulic cylinders 42 and 44 through conduits 75 and 76, and through conduit 77 to reservoir 69. Alternatively to open the clamp arms, the lift truck operator moves the spool of the control valve 70 to the right, thereby directing fluid from the pump 68 through conduit 77 and conduits 75 and 76 to the forward end of the clamp arm hydraulic cylinders 42 and 44, while fluid is simultaneously exhausted from the bases of the hydraulic cylinders through pilot operated check valves 78 and 79, conduits 73 and 74 and conduit 72 back to the reservoir 69. Hydraulic fluid passing through conduits 72 and 77 are also passed through a hydraulic swivel assembly 80 which includes a pin section 81 and a surrounding sleeve 82.

The second control valve 71 on the lift truck 14 regulates the flow of hydraulic fluid to the hydraulic rotator motor 83. Alternatively, by actuation of a switch 84 and through solenoid selector valve 85, the control valve 71 regulates the flow of hydraulic fluid to the pivot frame hydraulic cylinder 66. When switch 84 is not engaged, the clamp assembly may be rotated in a clockwise direction by movement of the spool of valve 71 to the left, thereby directing hydraulic fluid from the pump 68 through conduit 86, solenoid selector valve 85, conduit 87 and hydraulic swivel assembly 80 to the hydraulic rotator motor 83, while fluid is simultaneously exhausted from the other motor port through check valve 88*a*, conduit 89, and conduit 90 to the reservoir 69. Conversely, the clamp assembly is rotated in a counter-clockwise direction by movement of the spool of valve 71 to the right, thereby directing hydraulic fluid from the pump 68 through conduit 90, solenoid solenoid selector valve 85, conduit 89 and hydraulic swivel assembly 80 to the hydraulic rotator motor 83, while fluid is simultaneously exhausted from the other motor port through check valve 88*b*, conduit 87 and conduit 86 to the reservoir 69. The check valves 88*a* and 88*b* lock the motor when fluid is not being pumped to the motor, thus preventing unintended rotation of the clamp assembly.

When the switch 84 is engaged, the spool of solenoid selector valve 85, which is located on either the clamp assembly of the truck, is shifted to the left, thereby causing fluid that normally would be directed to the motor 83 to be diverted to the pivot frame hydraulic cylinder 66. To extend the hydraulic ram assembly 66, and therefore move the sub-frame 22 into the extended, unequal arm extension position, the spool of control valve 71 is moved to the left, thereby allowing fluid from the pump 68 to be pumped through conduit 86, solenoid selector valve 85 and conduit 91 to the base of the hydraulic ram assembly 66, while fluid is simultaneously exhausted from the front end of the hydraulic cylinder 66, through conduit 92 and conduit 90 to the reservoir 69. Conversely, to contract the hydraulic cylinder 66 and return the sub-frame 22 to the retracted, equal arm extension position, the spool of control valve 71 is moved to the right, thereby allowing fluid from the pump 68 to be pumped through conduit 00, solenoid 85 and conduit 92 to the front end of the hydraulic ram assembly 66, while fluid is simultaneously exhausted from the base of the hydraulic cylinder 66, through conduit 91 and conduit 86 to the reservoir 69.

Actuation of the pivot frame hydraulic cylinder 66 causes the sub-frame to be retracted or extended, thereby shifting the clamp assembly 10 between position of substantially equal arm extension, as shown in FIG. 5, and position of substantially unequal arm extension, as shown in FIG. 6. When the roll clamp 10 is pivoted between the equal arm extension position and the unequal arm position, the roll clamp's center of gravity 94 experiences an upward or downward side shift along the arcuate path 96, while the roll's center of gravity 102 experiences an opposite downward or upward side shift along the arcuate path 104.

In operation, the roll clamp assembly 10 is rotated to a horizontal position and the sub-frame is extended so the upper or "long side" clamp arm 32 extends forwardly a greater distance than the lower or "short side" clamp arm 42, as shown in FIG. 6. With the clamp in this position, a horizontally positioned roll 100 lying on a horizontal surface, such as a floor or platform, may be engaged by actuation of the clamp arm hydraulic cylinders to close the clamp arms about the roll. Next, the roll 100 is lifted upwardly along the longitudinal axis of the lift truck lifting apparatus 14. The rotator 18 is then actuated, and the roll 100 is rotated to a substantially vertical position. At this point, clamp may be pivoted to facilitate positioning. The roll may then be easily stacked directly adjacent other vertically positioned paper rolls.

Figure 8:
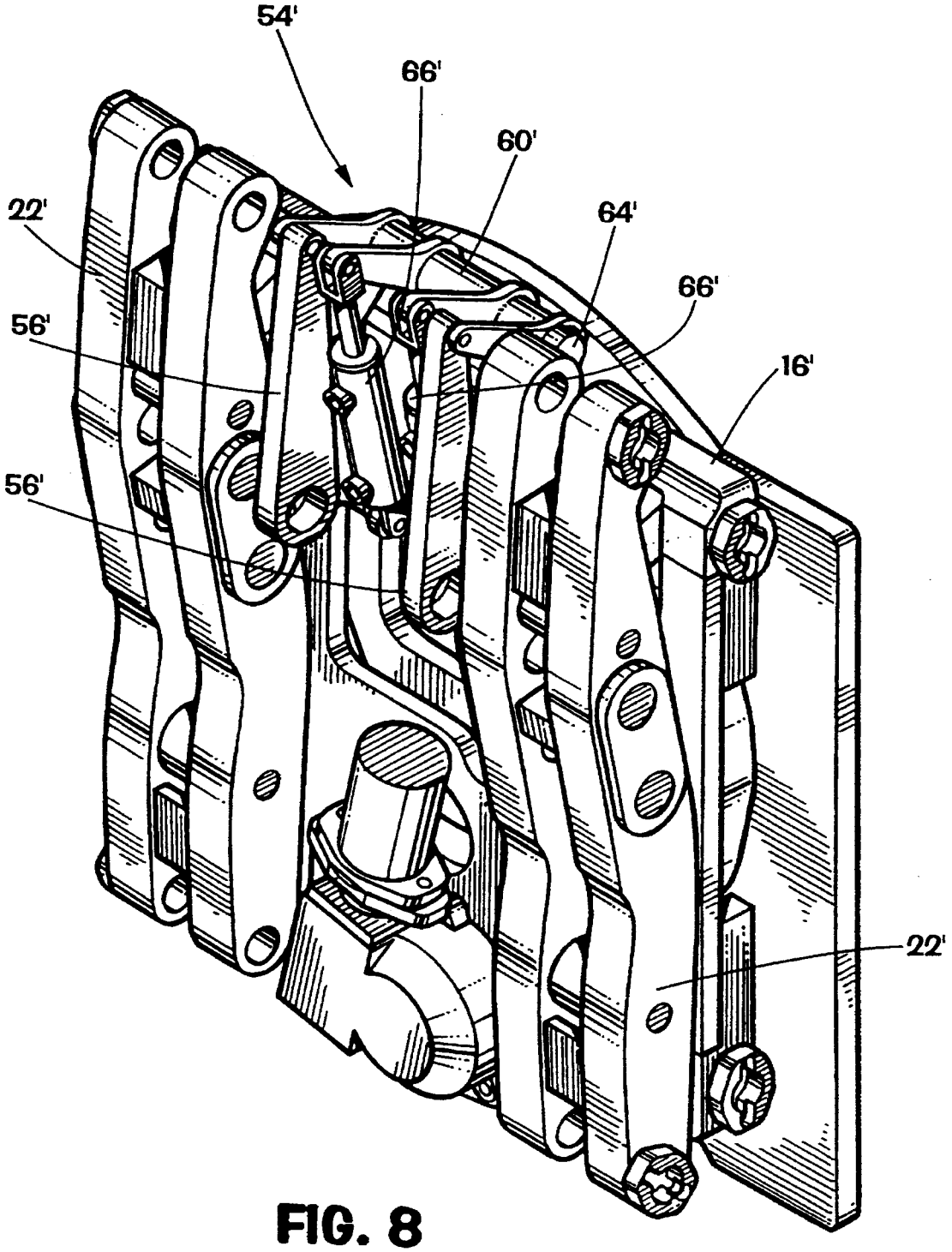
FIG. 8 shows a perspective view of a pivot frame roll clamp assembly according to an alternative embodiment, with portions removed to reveal underlying structure.

FIG. 8 shows a clamp assembly having a pivot frame motive means 54' according to an alternative embodiment. The pivot frame motive means 54' is similar to the pivot frame motive means of the first embodiment wherein like reference numerals indicate like components. According to the embodiment shown in FIG. 8, the pivot frame motive means 54' includes a pivot yoke 56' comprising first and second pivot yoke arm members. Each pivot yoke arm member has a first end pivotally connected to the sub-frame 22' and "long side" clamp arm (not shown) by a pivot pin (not shown). The other end of each pivot yoke arm member 56' is pivotally connected to a pair of arms extending from the yoke stabilizer 60'. The yoke stabilizer 60' is pivotally connected to the mounting frame 16' by pivot pin 64'. Hydraulic cylinders 66' having a fixed end pivotally connected to the mounting frame 16' and an extendable end connected to the pivot yoke arm members 56' and the arms of the yoke stabilizer 60', provide the force necessary to move the sub-frame 22' between the extended and retracted positions.

The illustrated embodiments are shown by way of example only. The spirit and scope of the invention is not to be restricted by the preferred embodiments shown.

We claim:

1. A pivot frame roll clamp assembly configured for attachment to a lift truck, said pivot frame roll clamp assembly comprising:

a mounting frame configured to be rotatably mounted upon a lifting apparatus of a lift truck;

a sub-frame connected to said mounting frame for permitting eccentric pivotal motion of the sub-frame with respect to the mounting frame;

a plurality of pivot arms for connecting said sub-frame to said mounting frame, each of said plurality of pivot arms having a first end pivotally connected to said sub-frame and a second end pivotally connected to said mounting frame;

first and second clamp arms, each pivotally connected at a first end thereof to the sub-frame;

pivot frame motive means for eccentrically pivoting the sub-frame with respect to the mounting frame;

clamp arm motive means for selectively pivoting the first and second clamp arms to selectively open and close the space between the clamp arms.

2. The pivot frame roll clamp assembly according to claim 1, wherein said plurality of pivot arms comprises four pivot arms.

3. The pivot frame roll clamp assembly according to claim 1, wherein said clamp arm motive means comprises at least first and second hydraulic cylinders for urging said respective first and second clamp arms toward an open position or a closed position, each hydraulic cylinder having a first end connected to one of the first and second clamp arms and a second end connected to the sub-frame.

4. The pivot frame roll clamp assembly according to claim 1, further comprising a paper roll contact pad mounted on a second end of each of said first and second clamp arms.

5. The pivot frame roll clamp assembly according to claim 1, wherein said pivot frame motive means comprises:

a pivot yoke having a first end pivotally connected to the sub-frame;

a yoke stabilizer having a first end pivotally connected to the mounting frame and a second end pivotally connected to a second end of said pivot yoke; and a hydraulic cylinder having a first end connected to the mounting frame and a second end pivotally connected to the second end of the pivot yoke and the second end of the yoke stabilizer.

6. The pivot frame roll clamp assembly according to claim 5, wherein the second end of the hydraulic cylinder is pivotally connected to the second end of the pivot yoke and the second end of the yoke stabilizer by a pivot pin.

7. The pivot frame roll clamp assembly according to claim 1, further comprising means for rotating said pivot frame roll clamp assembly between a substantially horizontal position and a substantially vertical position.

8. The pivot frame roll clamp assembly according to claim 1, wherein said first clamp arm exhibits a length equal to a length of said second clamp arm.

9. The pivot frame roll clamp assembly according to claim 1, wherein said clamp assembly exhibits a center of gravity, and upon actuation of said pivot frame motive means, a side shift in the clamp center of gravity is offset by an opposite side shift in the center of gravity of a roll held by the clamp assembly.

10. A pivot frame roll clamp assembly configured for attachment to a lifting apparatus of a lift truck for engaging a cylindrical object, said pivot frame roll clamp assembly comprising:

means for rotatably mounting said pivot frame roll clamp assembly upon the lifting apparatus of the lift truck;

means for engaging said cylindrical object;

sub-frame means for carrying said means for engaging; and first motive means for eccentrically pivoting the sub-frame carrying means and said engaging means with respect to the rotatable mounting means; and second motive means for selectively engaging and releasing said engaging means.

11. The pivot frame roll clamp assembly according to claim 10, wherein the rotatable mounting means comprises a mounting frame configured to be rotatably mounted upon the lifting apparatus of the lift truck.

12. The pivot frame roll clamp assembly according to claim 11, wherein said eccentrical pivoting means comprises a sub-frame connected to said mounting frame for permitting eccentric pivotal motion of the sub-frame with respect to said mounting frame.

13. The pivot frame roll clamp assembly according to claim 12, wherein said engaging means comprises first and second clamp arms pivotally connected to said sub-frame.

14. The pivot frame roll clamp assembly according to claim 10, wherein said engaging means comprises first and second clamp arms pivotally connected to said eccentrical pivoting means.

15. The pivot frame roll clamp assembly according to claim 10, wherein said second motive means comprises hydraulic cylinders, each having a first end connected to said engaging means and a second end connected to said eccentrical pivoting means, for operatively engaging or releasing said engaging means.

16. The pivot frame roll clamp assembly according to claim 10, wherein said first motive means comprises:

a pivot yoke having a first end pivotally connected to the eccentrical pivoting means;

a yoke stabilizer having a first end pivotally connected to the rotatable mounting means and a second end pivotally connected to a second end of said pivot yoke; and a hydraulic cylinder having a first end connected to the mounting frame and a second end pivotally connected to the second end of the pivot yoke and the second end of the yoke stabilizer.

17. The pivot frame roll clamp assembly according to claim 10, wherein said eccentrical pivoting means comprises a sub-frame connected to said rotatable mounting means for permitting eccentric pivotal motion of the sub-frame with respect to said rotatable mounting means.

18. The pivot frame roll clamp assembly according to claim 17, further comprising a plurality of pivot arms for connecting said sub-frame to said rotatable mounting means, each of said plurality of pivot arms having a first end pivotally connected to said sub-frame and a second end pivotally connected to said rotatable mounting means.

19. The pivot frame roll clamp assembly according to claim 18, wherein said plurality of pivot arms comprises four pivot arms.

* * * * *